United States Patent [19]

Geller

[11] Patent Number: 4,485,921

[45] Date of Patent: Dec. 4, 1984

[54] PACKAGE FOR A MASK

[75] Inventor: Stanley Geller, Roslyn Heights, N.Y.

[73] Assignee: Fun World, a division of Easter Unlimited, Inc., Glen Cove, N.Y.

[21] Appl. No.: 560,368

[22] Filed: Dec. 12, 1983

[51] Int. Cl.[3] ..... B65D 73/00; B65D 65/38; B65D 85/18

[52] U.S. Cl. ..... 206/471; 206/483; 206/281; 206/292; 206/457; 206/458

[58] Field of Search ..... 206/471, 461, 462, 45.33, 206/483, 278, 281, 292, 575, 458, 457, 44.11

[56] References Cited

U.S. PATENT DOCUMENTS

| | | | |
|---|---|---|---|
| 2,605,893 | 8/1952 | Leavitt | 206/44.11 |
| 2,757,791 | 8/1956 | Kendig | 206/292 |
| 3,190,435 | 6/1965 | Schlanger | 206/7 |
| 3,300,040 | 1/1967 | Ferguson | 206/46 |
| 3,488,413 | 1/1970 | Watts, Jr. | 264/89 |
| 3,502,486 | 3/1970 | Lundquist | 99/171 |
| 3,530,984 | 9/1970 | Howard | 206/82 |
| 3,837,476 | 9/1974 | Schwartz | 206/45.34 |
| 3,966,045 | 6/1976 | Perdue | 206/443 |
| 4,189,049 | 2/1980 | Silver | 206/281 |
| 4,397,701 | 8/1983 | Johnson et al. | 206/575 |
| 4,453,629 | 6/1984 | Goldberg | 206/457 |

*Primary Examiner*—William T. Dixson, Jr.
*Attorney, Agent, or Firm*—Blum Kaplan Friedman Silberman & Beran

[57] ABSTRACT

A package for a mask having a predetermined configuration with a front convex surface and a rear concave surface in which the face of a wearer of a mask is to be positioned. The package includes a molded plastic shell having a convex surface adapted to conform to the predetermined configuration of the mask. The convex surface of the shell fits in the rear concave surface of the mask. A coupling device releasably couples the mask to the shell so that the front concave surface of the mask is exposed. The plastic shell may include an extension which permits the package to be suspended from a support for display in a store.

8 Claims, 3 Drawing Figures

PACKAGE FOR A MASK

BACKGROUND OF THE INVENTION

The present invention is directed to a package for a mask such as a Halloween mask or the like, and, in particular, to a package for a mask which permits the mask to be exposed to the consumer when on display to allow the consumer to examine and touch the mask without requiring the opening of a package.

In the past, masks such as Halloween masks, masks for costume balls or the like have come packaged in plastic bags or other types of enclosures which completely surround the masks and do not permit examination and manipulation thereof without the opening of the package. In one type of prior mask package, the mask is captured between transparent, blister cards which also suffers the disadvantages noted above with respect to conventional mask packaging.

One possibility would be to leave the mask completely loose without a package. If this were done, there would be no way to provide information with the mask and no way to prevent damage to the mask. Another alternative would be to provide a box with a lift off top for each mask. Such boxes are bulky and are less than completely satisfactory. Accordingly, it is desired to provide a package for a mask which overcomes the problems noted above and which permits the mask to be examined, touched and properly displayed to consumers.

SUMMARY OF THE INVENTION

Generally speaking, in accordance with the present invention, a package for a mask having a predetermined configuration, such as a Halloween mask or the like, is provided. Such masks have a front convex surface and a rear concave surface in which the face of a wearer of the mask is to be positioned. The package of the present invention includes a molded plastic shell having a convex surface adapted to conform to the predetermined configuration of the mask. The convex surface of the shell fits in the rear concave surface of the mask. A coupling device is provided for releasably coupling the mask to the shell so that the front convex surface of the mask is exposed. The plastic shell may include an extension having an opening for permitting the shell with mask thereon to be suspended from a support for display in a store or the like.

In a preferred embodiment, the mask is held to the conformed plastic shell by means of at least one tag attachment which extends through the mask and the shell. A portion of the shell may extend beyond the mask and a header card attached thereto to provide a complete and inexpensive package for a mask.

Accordingly, it is an object of the present invention to provide an improved package for a mask such as a Halloween or other costume mask.

Another object of the present invention is to provide a package for a mask which permits the front of the mask to be exposed to the consumer for examination.

A further object of the present invention is to provide an improved package for a mask which is inexpensive to construct and which provides a neat package for a mask while permitting the mask to be exposed for examination by consumers.

Still other objects and advantages of the invention will in part be obvious and will in part be apparent from the specification.

The invention accordingly comprises an article of manufacture possessing the features, properties, and relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figures 1, 2, 3:
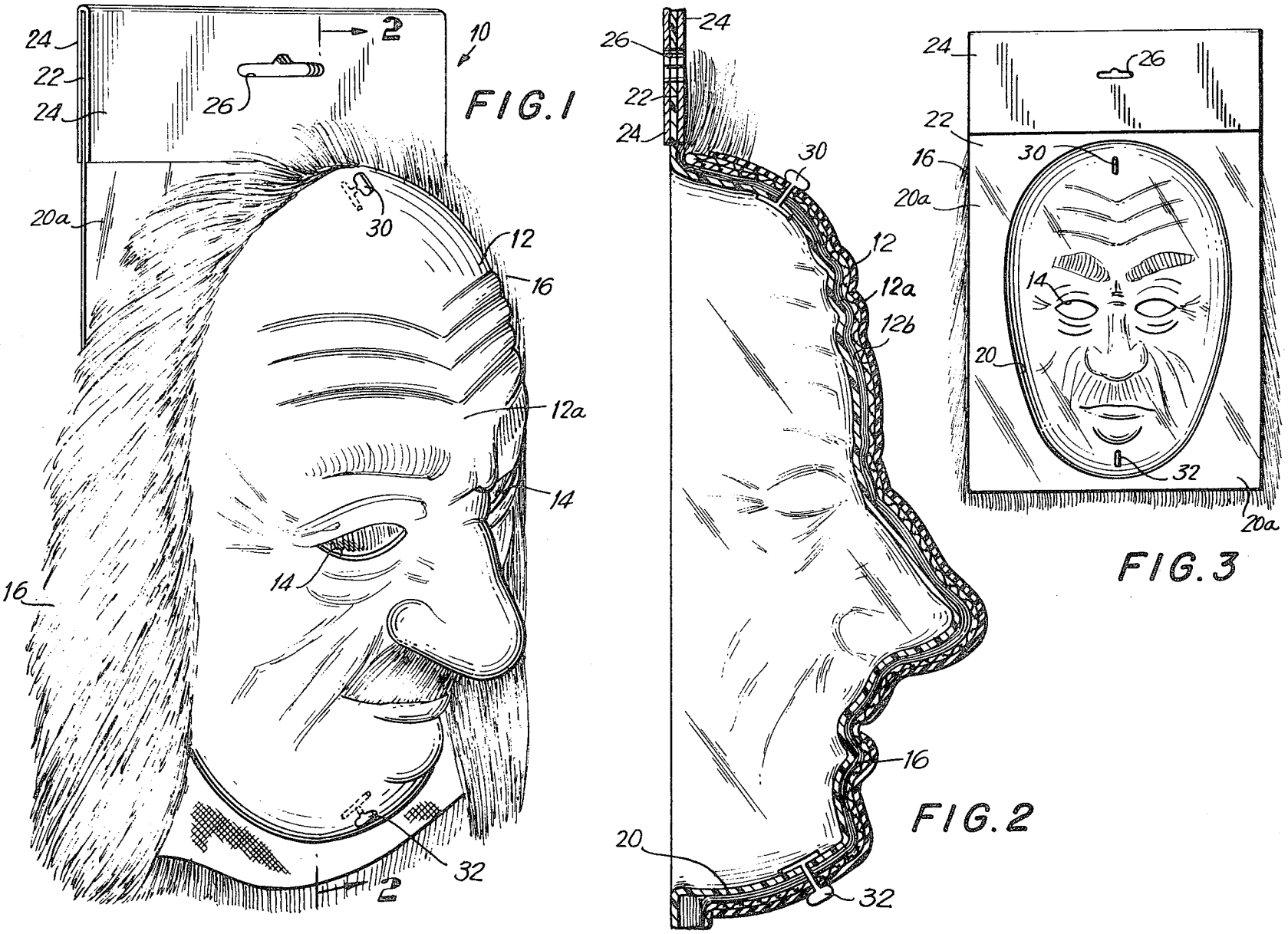
FIG. 1 is a front, left-side elevational view of a package for a mask constructed in accordance with a preferred embodiment of the present invention, with a mask shown in position.
FIG. 2 is a sectional view taken along line 2—2 of FIG. 1.
FIG. 3 is a rear elevational view of the package for a mask with mask in position as depicted in FIG. 1.

Reference is made to the drawings which depict a package, generally indicated at 10, constructed in accordance with the present invention and adapted to support and display a mask 12. Mask 12 has a predetermined configuration and is adapted to be worn over the face of a wearer. Mask 12 includes a front concave surface 12*a* and a rear convex surface 12*b* which fits over the face of a wearer. Mask 12 may include eye openings 14 to permit a wearer to see therethrough. In addition, in the mask depicted, a covering material 16 which simulates hair is provided to extend over the head of the wearer to hold the mask in place.

Package 10 includes a shell 20 made from a synthetic resin or plastic suitable for use as a blister package. It is noted that shell 20 may be clear plastic. Shell 20 is shaped to conform to the rear convex surface 12*b* of mask 12 and to fit therein. Shell 20 may also include a flat border portion 20*a*. A portion 22 of shell 20 extends beyond mask 12. A header card 24 such as a piece of cardboard or the like may be folded over extension 22 and may include identifying indicia thereon such as the name of the manufacturer and price. An opening 26 may be provided through header card 24 and extension 22 in order to permit package 10 to be suspended from an appropriate support or bar in the store in which it will be displayed.

In preparing the package, mask 12 is placed over shell 20 and releasably coupled thereto by appropriate means. In the mask depicted, covering material 16 is disposed intermediate rear surface 12*b* of mask 12 and shell 20. As depicted, mask 12 is releasably coupled to shell 20 by means of first and second tag attachments 30 and 32. Tag attachments 30 and 32 extend through mask 12, hairpiece 16 and shell 20 as depicted in order to hold mask 12 to shell 20.

Since shell 20 conforms to the shape of mask 12, it aids in maintaining the shape of mask 12. Moreover, the front of mask 12 is completely open and exposed to consumers so that consumers may readily examine the mask and even touch it to determine whether that is the product which the consumer wants. The header card contains the required information for the consumer and can be readily attached to the extension of the shell during the packaging process. A neat and inexpensive package is provided.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the foregoing claims are intended to cover all of the generic and specific features of the invention herein described and all statements of the scope of the invention which, as a matter of language, might be said to fall therebetween.

What is claimed is:

1. A package for a mask having a predetermined configuration with a front convex surface and a rear concave surface in which the face of a wearer of the mask is to be positioned, comprising a molded shell having a convex surface adapted to conform to the predetermined configuration of said mask, the convex surface of said shell fitting in said rear concave surface of said mask, and coupling means for releaseably coupling said mask to said shell so that said front convex surface of said mask is exposed, said front convex surface of said mask remaining uncovered by any packaging while said mask is coupled to said shell to permit manual examination thereof.

2. The package for a mask as claimed in claim 1, wherein said coupling means includes a tag attachment which extends through said mask and said shell to hold said mask to said shell.

3. The package for a mask as claimed in claim 1, wherein said molded shell is a clear plastic material.

4. The package for a mask as claimed in claim 1, wherein said shell includes suspending means for permitting said shell to be suspended from a support.

5. The package for a mask as claimed in claim 4, wherein said suspending means includes a portion of said shell which extends beyond said mask, said extending portion having an opening.

6. The package for a mask as claimed in claim 5, wherein said suspending means includes a header card secured to said extending portion.

7. The package for a mask as claimed in claim 6, wherein said coupling means includes at least one tag attachment which extends through said mask and said shell.

8. The package for a mask as claimed in claim 1, wherein said shell is a transparent synthetic resin suitable for use in blister packages.

* * * * *